US011448468B2

(12) United States Patent
Masgrau

(10) Patent No.: US 11,448,468 B2
(45) Date of Patent: Sep. 20, 2022

(54) PLATE FOR HEAT EXCHANGE ARRANGEMENT AND HEAT EXCHANGE ARRANGEMENT

(71) Applicant: ALFA LAVAL CORPORATE AB, Lund (SE)

(72) Inventor: Marcello Masgrau, Binissalem (ES)

(73) Assignee: ALFA LAVAL CORPORATE AB, Lund (SE)

( * ) Notice: Subject to any disclaimer, the term of this patent is extended or adjusted under 35 U.S.C. 154(b) by 194 days.

(21) Appl. No.: 16/607,031

(22) PCT Filed: May 11, 2018

(86) PCT No.: PCT/SE2018/050488
§ 371 (c)(1),
(2) Date: Oct. 21, 2019

(87) PCT Pub. No.: WO2018/208218
PCT Pub. Date: Nov. 15, 2018

(65) Prior Publication Data

US 2020/0132386 A1 Apr. 30, 2020

(30) Foreign Application Priority Data

May 11, 2017 (SE) ..... 1750583-5

(51) Int. Cl.
*F28F 3/08* (2006.01)
*F28D 9/00* (2006.01)
*F28F 3/04* (2006.01)

(52) U.S. Cl.
CPC ..... *F28D 9/005* (2013.01); *F28D 9/0037* (2013.01); *F28F 3/046* (2013.01); *F28D 9/0056* (2013.01);
(Continued)

(58) Field of Classification Search
CPC ..... F28D 9/005; F28D 9/0037; F28D 9/0056; F28F 3/046; F28F 3/044; F28F 2250/104
(Continued)

(56) References Cited

U.S. PATENT DOCUMENTS 6,199,626 B1 3/2001 Wu et al.
10,876,762 B2 * 12/2020 Jeong ..... F24H 9/0026
(Continued)

FOREIGN PATENT DOCUMENTS

CN 101405554 B 5/2011
CN 103477176 A 12/2013
(Continued)

OTHER PUBLICATIONS

International Search Report for PCT/SE2018/050488 dated Aug. 21, 2018.
(Continued)

*Primary Examiner* — Claire E Rojohn, III
(74) *Attorney, Agent, or Firm* — Birch, Stewart, Kolasch & Birch, LLP

(57) ABSTRACT

A plate for a heat exchange arrangement for the exchange of heat between a first and a second medium. The plate has a first heat transferring surface in contact with the first medium and a second heat transferring surface in contact with the second medium. The plate includes an inlet porthole for the first medium; an inlet porthole for the second medium, and an outlet porthole for the first medium. The first heat transferring surface includes a protrusion forming at least one ridge arranged to divide the heat transfer surface into at least a first region in direct thermal contact with the inlet porthole for the second medium, and a second region not in direct thermal contact with the inlet porthole for the second medium. The second region substantially surrounds the first region. The inlet porthole for the first medium is
(Continued)

arranged in the first region, while the outlet porthole for the first medium is arranged in the second region. Moreover, the at least one ridge forms at least one elongated transfer channel arranged to convey the first medium from the first region to the second region.

16 Claims, 8 Drawing Sheets

(52) U.S. Cl.
CPC ..... *F28F 3/044* (2013.01); *F28F 2250/104* (2013.01)

(58) Field of Classification Search
USPC ..... 165/167
See application file for complete search history.

(56) References Cited

U.S. PATENT DOCUMENTS

| | | | | |
|---|---|---|---|---|
| 2001/0006103 | A1* | 7/2001 | Nash | F28F 9/0268 165/167 |
| 2003/0047303 | A1* | 3/2003 | Andersson | F28F 3/046 165/167 |
| 2005/0058535 | A1* | 3/2005 | Meshenky | F28F 13/06 415/121.3 |
| 2005/0194123 | A1* | 9/2005 | Strahle | F28F 3/048 165/167 |
| 2006/0081358 | A1 | 4/2006 | Pierre et al. | |
| 2006/0151147 | A1 | 7/2006 | Symonds | |
| 2011/0083833 | A1* | 4/2011 | Zorzin | F28D 9/005 165/166 |
| 2011/0303400 | A1 | 12/2011 | Scearce | |
| 2013/0284409 | A1 | 10/2013 | Odillard et al. | |
| 2014/0008046 | A1* | 1/2014 | Persson | F28F 3/042 165/185 |
| 2014/0158328 | A1* | 6/2014 | Persson | F28F 9/001 165/109.1 |
| 2015/0369475 | A1 | 12/2015 | Silversand | |
| 2016/0187067 | A1* | 6/2016 | Kobayashi | F28D 9/005 165/166 |
| 2016/0245591 | A1 | 8/2016 | Masgrau | |
| 2016/0377319 | A1* | 12/2016 | Kim | F28D 9/0012 122/18.31 |

FOREIGN PATENT DOCUMENTS

| | | | |
|---|---|---|---|
| CN | 103759474 | B | 1/2018 |
| CN | 209588797 | U | 11/2019 |
| EP | 1376042 | A2 | 1/2004 |
| EP | 1 571 407 | A3 | 9/2010 |
| EP | 1 700 079 | B1 | 9/2010 |
| EP | 1 996 889 | B1 | 11/2011 |
| EP | 2 412 950 | A1 | 2/2012 |
| EP | 2 682 703 | A1 | 1/2014 |
| EP | 2757336 | A2 | 7/2014 |
| EP | 3 171 115 | A1 | 5/2017 |
| EP | 3 104 110 | B1 | 9/2018 |
| SE | 542 079 | C2 | 2/2020 |
| WO | WO 03/006911 | A1 | 1/2003 |
| WO | WO 2004/023055 | A1 | 3/2004 |
| WO | WO 2005/057118 | A1 | 6/2005 |
| WO | WO 2015/057115 | A1 | 4/2015 |

OTHER PUBLICATIONS

Written Opinion of the International Searching Authority for PCT/SE2018/050488 dated Aug. 21, 2018.

Supplementary European Search Report for European Application No. 18799364, dated Nov. 30, 2020.

English Translation of Chinese Office Action and Search Report for Chinese Application No. 201880030777.9, dated Sep. 9, 2020.

* cited by examiner

PLATE FOR HEAT EXCHANGE ARRANGEMENT AND HEAT EXCHANGE ARRANGEMENT

TECHNICAL FIELD

The present invention relates to plate for a heat exchange arrangement and a heat exchange arrangement for the exchange of heat between a first and a second medium.

BACKGROUND OF THE INVENTION

Plates and heat exchange arrangements of the above-mentioned type are used to e.g. heat up tap water "on-demand" without storage tanks by combustion of fuel, typically gas. The water is then heated from about 20° C. to about 60° C. The gas is at the same time cooled by the tap water, i.e. the tap water is heated by the gas. Combustion gases must be cooled from about 1500° C. to as low temperature as possible. Condensation provides additional thermal energy from the fuel due to the release of latent heat. Water vapour from the combustion gases condenses when in contact with low temperature metal surfaces of the heat exchange arrangement. The temperature of the metal surfaces varies along the heat exchange arrangement and it is determined by the temperature and flow characteristics of water and gas at every location.

Thermal problems have previously prevented use of cost effective and compact heat exchange arrangements in particularly gas-fired hot water heaters and burners. The gas from the burner flowing into the heat exchange arrangement is as mentioned over 1500° C. and the variations in temperature are extremely quick. This can cause thermal stresses and leakage.

High metal temperatures lead to high water temperatures, which in turn lead to boiling risk and thus, risk for mechanical damage of the heat exchange arrangement. Other risks are scaling, fouling (precipitates from water that attach to the metal surface), causing danger of decreasing water cooling capacity and thus, the presence of a positive feedback loop towards higher metal temperatures over time. High metal temperatures also lead to high thermal stresses in the metal, which in turn can lead to formation of cracks and thus, failure (leakage) of the product.

Prior art plates for heat exchange arrangements and heat exchange arrangements such as those described and illustrated in e.g. US 2001/0006103 A1, EP 1700079 B1 and EP 2412950 A1, are not capable of solving the above-mentioned drawbacks and problems in a satisfactory manner.

Further prior art includes WO 2015/057115 A1, EP 2682703 A1 and EP 1571407 A3.

Moreover, EP 15195092.0, which has not yet been published at the time of filing of the present application, discloses a heat exchange plate and a heat exchange arrangement which is similar to those presented herein, but in which the first heat medium is led across each heat exchanging plate across first region, from a first inlet to a first outlet, after which it is conveyed, via an external channel, which is not arranged on the plate itself, to a second inlet on the same plate in a second region, and finally out through a second outlet. Hence, on its way from the first region to the second region, the first heat medium leaves the heat plate. Using such an external channel, this design provides advantageous cooling of an end piece of the heat exchanger, but is on the other hand less efficient and more complex than the solution presented herein.

SUMMARY OF THE INVENTION

An object of the present invention is therefore to overcome or ameliorate at least one of the disadvantages and problems of the prior art, or to provide a useful alternative.

The above object may be achieved by the subject matter of claim 1, i.e. by means of the plate according to the present invention. The plate in question, which is a plate for a heat exchange arrangement for the exchange of heat between a first and a second medium, has a first heat transferring surface arranged in use to be in contact with the first medium and a second heat transferring surface arranged in use to be in contact with the second medium. The plate further comprises an inlet porthole for the first medium, an inlet porthole for the second medium and an outlet porthole for the first medium. The first heat transferring surface comprises a protrusion forming at least one ridge which is arranged to divide said heat transfer surface into at least a first region, which is in direct thermal contact with the said inlet porthole for the second medium, and a second region, which is not in direct thermal contact with the inlet porthole for the second medium. The second region substantially surrounds the first region. The inlet porthole for the first medium is arranged in said first region, while the outlet porthole for the first medium is arranged in the second region. Moreover, the said at least one ridge forms at least one elongated transfer channel arranged to convey the said first medium from the first region to the second region.

The above object may be achieved also by the subject matter of claim 16, i.e. by means of the heat exchange arrangement according to the present invention. The arrangement is arranged for the exchange of heat between a first and a second medium, and comprises a plurality of first plates and a plurality of second plates as defined above. The said second plates are mirror copies of said first plates, possibly with the exception of bent side edges, that are preferably bent in the same direction when plates are stacked one on top of the other in an alternating manner, so that such alternatingly stacked plates are fully stackable, and so that corresponding dimples of adjacent, mirrored plates abut. The first and the second plates are alternately stacked to form a repetitive sequence of a first flow channel for the first medium and a second flow channel for the second medium. Each first flow channel is defined by the first heat transferring surface of the first plate and the first heat transferring surface of the second plate and each second flow channel by the second heat transferring surface of the first plate and the second heat transferring surface of the second plate. The inlet porthole for the first medium on the first and the second plates define between them inlets for the first medium. The outlet porthole for the first medium on the first and the second plates define between them outlets for the first medium. The inlet portholes for the second medium on the first and the second plates define between them inlets for the second medium. The protrusions on the first heat transferring surfaces of the first and the second plates are connected to each other to separate each first flow channel into at least the first and second regions as well as said at least one transfer channel for the first medium. Furthermore, each first flow channel is configured in use to direct a flow of the first medium from the inlet for the first medium to the outlet for the first medium, via the first region, the transfer channel and the second region.

Thus, thanks to the plate as defined above and the heat exchange arrangement as defined above, comprising a plurality of such plates, such that the flow of the first medium can be fed through the first flow channel therefor first through the first region and thereafter through the second region substantially surrounding the first region, optimum cooling of the second medium and thus, of the metal surfaces of the plates of the heat exchange arrangement is achieved while at the same time optimum heating of the first medium for use is achieved.

Thanks to the plate as defined above and the heat exchange arrangement as defined above, it is also possible to keep the temperature of the metal surfaces at acceptable levels from a product reliability point of view all over the heat exchange arrangement and thereby eliminate the particular risks regarding thermal fatigue and leakage. The combustion gas inlet region is a particularly critical area due to the very high temperature of the combustion gas.

Furthermore, thanks to the present invention, a unique plate and thus, a unique, cost effective and compact heat exchange arrangement comprising such unique plates is provided for use in, inter alia, gas-fired hot water heaters and burners. Locating the burner in the burning chamber of a heating device comprising a heat exchange arrangement according to the present invention provides for a compact design and higher energy efficiency and extensive condensation is achieved by integrated cooling of the burning chamber and of the medium (gas) therein, which is used for heating the other medium (water).

The inlet porthole for the first medium, the first region, the transfer channel, the second region and the outlet porthole for the first medium may be arranged to convey the first medium from the inlet porthole for the first medium into the first region, further via the transfer channel to the second region and out through the outlet porthole for the first medium. Thereby, an efficient heat exchange action can be achieved within the plate itself, with no need for an external transfer channel arrangement.

BRIEF DESCRIPTION OF THE DRAWINGS

The above-mentioned and additional features of the present invention and the advantages therewith will be further described below by means of non-limiting examples with reference to the accompanying drawings. In the drawings.

Throughout all figures, the same reference numerals denote the same or corresponding parts and features.

It should be noted that the accompanying drawings are not necessarily drawn to scale and that the dimensions of some features of the present invention may have been exaggerated for the sake of clarity.

DETAILED DESCRIPTION OF PREFERRED EMBODIMENTS

The present invention will in the following be exemplified by embodiments thereof. It should be realized however, that the embodiments are included to explain principles of the invention and not to limit the scope of the invention as defined by the appended claims.

As already mentioned, the present invention relates to a plate for a heat exchange arrangement as well as to a heat exchange arrangement which comprises a plurality of said plates.

The plate for the heat exchange arrangement is configured for the exchange of heat between a first and a second medium. The general concept of the plate according to the present invention can be read out from particularly FIGS. 1-5.

Figure 1:
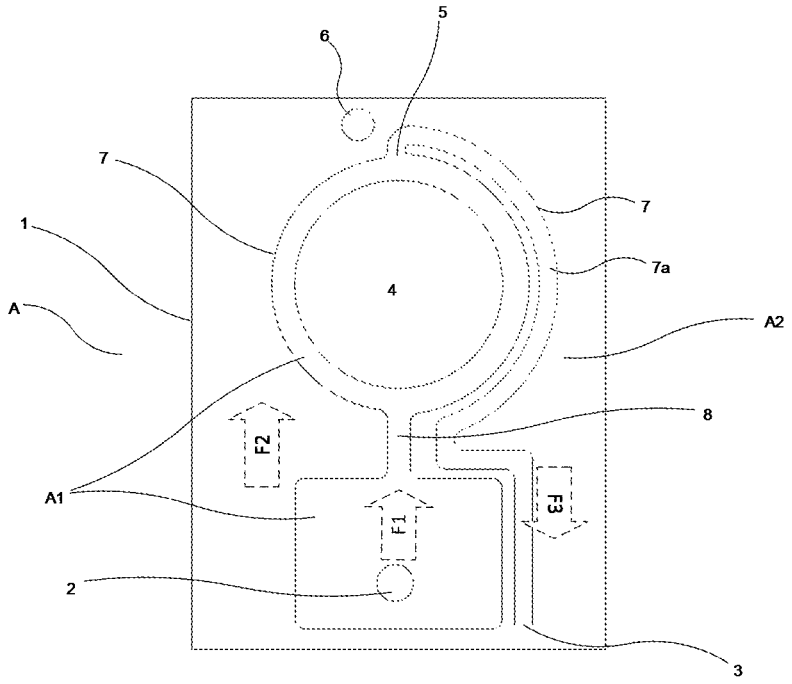
FIG. 1 is a very schematic plan view of a first heat transferring surface of a first general embodiment of a plate according to the invention for a heat exchange arrangement, said first heat transferring surface being arranged in use for contact with a first medium.

Accordingly, the plate 1 of FIG. 1 is as illustrated configured with a first heat transferring surface A for the first medium, which here is the medium to be heated, e.g. water, and, on the opposite side of the plate not illustrated in FIG. 1, a second heat transferring surface for the second medium, e.g. a gas such as hot combustion gases from an oxidation reaction, or air, for heating the first medium. The plate 1 is provided with an inlet porthole 2 for the first medium, permitting inflow of said first medium to the first side A of the plate, and an inlet porthole 4 for the second medium, permitting inflow of said second medium to the second side of the plate. The plate 1 is further provided with at least one outlet porthole 6 for the first medium, permitting outflow of said first medium from said first side A of the plate. Finally, the first heat transferring surface A of the plate 1 is configured with a protrusion 7 forming a ridge, preferably a continuous ridge, which is arranged to divide said heat transfer surface into a first region A1 and a second region A2. The first region A1 is in direct thermal contact with the said inlet porthole 4 for the second medium, while the second region A2 is not in direct thermal contact with the inlet porthole 4 for the second medium.

Herein, that a region is in "direct thermal contact" with a porthole means that the porthole in question is arranged through the plate in question on which the region in question is arranged, and that heat medium arranged in the region is separated from heat medium arranged in the porthole by only plate material, preferably by one single plate thickness of such plate material or by a single ridge of the type described and exemplified herein. Such separating plate material may preferably be in the form of a bent edge of the plate leading up to the porthole in question. Hence, such a region is in direct thermal contact with the porthole in question in the sense that thermal energy can be directly transferred between a certain first medium arranged in the region in question and a certain second medium arranged in the porthole in question via the plate material separating the two resulting volumes. An alternative, or additional, definition of "direct thermal contact" is that a first medium arranged in the region can heat exchange with a second medium arranged in the porthole without having to heat exchange with the first medium arranged in an additional region arranged between the region and the porthole. To the contrary, when a particular region is not in direct thermal contact with a particular porthole, this may preferably imply that thermal transfer between a first medium arranged in such region and a second medium arranged in such a porthole must take place via at least one intermediate medium-holding region volume, such as holding an additional amount of the first medium in question.

According to the invention, the inlet porthole 2 for the first medium is arranged in the first region A1. Preferably the first region A1 completely encloses the inlet porthole 2 for the first medium. Furthermore, the second region A2 substantially surrounds the first region A1, in the sense that all, or at least substantially all, points located in the second region A2 are arranged with a respective certain point located in the first region A1 between the second region A2 point in question and the inlet porthole 2 for the first medium, as viewed in a main plane of the plate in question. In the preferred case in which the inlet porthole 4 for the second medium is completely enclosed by the first region A1, the corresponding holds for each point of the first region A1, in particular in relation to the inlet porthole 4 for the second medium, which is preferably completely enclosed by the first region A1.

Preferably, in order to travel, in the same plane, from each point in the first region A1 to the border of the plate 1, it is necessary to traverse at least one point in the second region A2. Hence, in this sense the first region A1 is an "inner region" in relation to the second region A2, which is then an "outer region".

Furthermore, the outlet porthole 6 for the first medium is arranged in the second region A2, and the said at least one continuous ridge formed by said protrusion 7 preferably forms an elongated transfer channel 7*a* arranged to convey the first medium from the first region A1 to the second region A2.

The protrusion 7 is configured to provide for as good as possible, preferably optimum heat exchange between the first and second media. It is possible however, to configure the protrusion 7 in other ways than illustrated in FIG. 1, thereby dividing the first heat transferring surface A of the plate 1 into otherwise configured first and second regions A1 and A2, as will be exemplified below.

As is illustrated in FIG. 1, the protrusion 7 may be in the form of one single, connected protrusion, forming one single, connected ridge in turn defining said transfer channel 7*a*. Preferably, the ridge also defines the dividing line between the first A1 and second A2 regions. There may be more than one ridge, which ridges then together form a ridge aggregate. In this case, the ridges of said ridge aggregate may each as such be continuous, but all such ridges may not be connected to each other. What is important is that one or several of said ridges together define the transfer channel 7*a* running between the first A1 and the second A2 regions.

As such, the transfer channel 7*a* comprises a transfer channel inlet 5, located at the first region A1 such that first medium can flow freely from the first region A1 and into the transfer channel 7*a*; and a transfer channel outlet 3, located at the second region A2 such that first medium can flow freely from the transfer channel 7*a* and out into the second region A2. Preferably, the transfer channel 7*a* comprises no additional openings, so that first medium passing from the first region A1 to the second region A2 can only pass via the transfer channel 7*a*, and so that medium passing through the transfer channel 7*a* can only move between the said regions A1, A2. It is understood that the corresponding pertains to the case when there are several transfer channels 7*a*, 7*b*, as exemplified in FIG. 4. In this case, there are preferably no additional openings, apart from openings 5*a*, 5*b*, 3*a*, 3*b*, so that the first medium can only pass via either of said transfer channels 7*a*, 7*b* between regions A1, A2.

Specifically, the inlet porthole 2 for the first medium, the first region A1, the transfer channel 7*a*, the second region A2 and the outlet porthole 6 for the first medium are arranged to convey the first medium from the inlet porthole 2 for the first medium into the first region A1, further via the transfer channel 7*a*, 7*b* to the second region A2 and out through the outlet porthole 6 for the first medium. Preferably, this is the only flow path available for the first medium across the said first surface.

As clearly illustrated both in FIG. 1 and in the other figures, the transfer channel 7*a* is arranged along the heat plate 1, and is hence not an external transfer channel in relation to the heat plate 1. Specifically, the said flow path is in its entirety a flow path along the said first heat transferring surface A, defined by said one or several ridges 7 in the plate 1.

Preferably, the first region A1 and the second region A2 are separated by and share one and the same part of said continuous ridge 7, at least along part of said ridge 7. Then, a general flow direction F1, F2 of the first medium through the first A1 and second A2 regions on either side of the said part of the ridge 7 in question, respectively, are substantially parallel to each other. For instance, the general flow direction F1, F2 in each region A1, A2 may be coarsely defined as whether or not the first medium flowing through the region A1 in question, during use, flows from one side or edge of the plate 1 to an opposite side or edge. In this case, "substantially parallel" means that the first medium flows through both the first A1 and the second A2 region in the corresponding coarse direction F1, F2 in relation to the said plate 1 sides or edges.

As illustrated in FIG. 1, this is preferably achieved by the transfer channel 7*a* being arranged to convey the first medium, between the first region A1 and the second A2 region, in a direction F3 which is generally opposite, in the corresponding coarse sense, to the said parallel general flow direction F1, F2. In other words, the first medium flows in a particular general direction F1 through the first region A1, after which the transfer channel 7*a* brings the first medium back, in the opposite general direction F3, such as upstream in relation to the general flow direction F1 of the first region A1, to a location in the second region A2 from which the first medium again flows in the said particular general direction F2. This is illustrated using flow direction arrows in FIGS. 1-5.

In particular, it is preferred that the transfer channel 7*a* is elongated, as mentioned above, preferably in the sense that it is at least 10 times longer than it is wide. This is clearly the case in, for instance, FIG. 1.

As is further illustrated in FIG. 1, the said entry point 5 of the transfer channel 7*a*, at the first region A1, is preferably arranged closer to the inlet porthole 4 for the second medium than the exit point 3 of the transfer channel 7*a*, at the second region A2. Preferably, the said parallel general flow direction F1, F2 is generally directed from the inlet porthole 2 for the first medium towards the inlet porthole 4 for the second medium. Further preferably, the inlet porthole 4 for the second medium is located between the inlet porthole 2 for the first medium and the transfer channel 7*a* entry 5, closer to the transfer channel 7*a* entry 5 than the inlet porthole 2 for the first medium, so that the first medium flows past the inlet porthole 4 for the second medium only just prior to entering the transfer channel 7*a*.

In FIG. 1, the ridge 7 forms only one transfer channel 7*a*, and also forms the barrier between the first A1 and second A2 regions. This way, one single ridge 7 is sufficient. As can be seen from FIG. 1, the transfer channel 7*a* passes in such a way so that only one outlet porthole 5 for the first medium is sufficient. Specifically, in FIG. 1 the transfer channel 7*a* follows an external contour of the first region A1, so that substantially all first medium passes, on its way from the transfer channel 7*a* outlet 3 to the outlet 6 for the first medium, along the side of the transfer channel 7*a* facing away from the first region A1.

Figure 2:
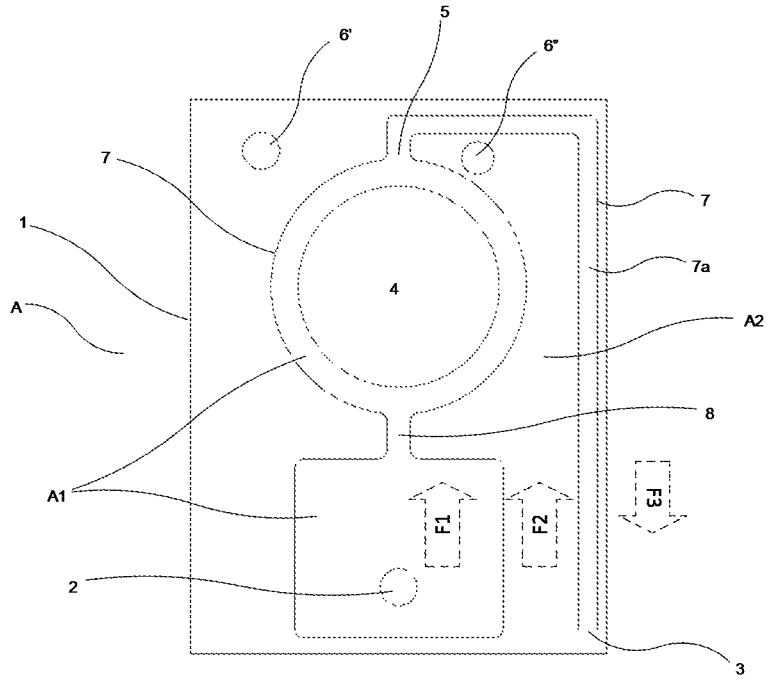
FIG. 2 is very schematic plan view of a first heat transferring surface of a second general embodiment of a plate according to the invention for a heat exchange arrangement said first heat transferring surface being arranged in use for contact with a first medium.

FIG. 2 illustrates an alternative configuration, which is similar to the one shown in FIG. 1 but wherein the transfer channel 7*a* instead runs along, closely to, a side edge of the plate 1. In this case, there are preferably two outlet portholes 6', 6" for the first medium. Furthermore, the first medium passes, on its way from the transfer channel 7*a* outlet 3 to the respective outlet porthole 6', 6" for the first medium, partly between the transfer channel 7*a* and the first region A1, and partly on the other side of the first region A1 with respect to the transfer channel 7*a*. In both FIG. 1 and FIG. 2 configurations, the first medium hence passes on either side of the first region A1 after leaving the transfer channel 7*a* outlet 3. In FIG. 1, the outlet porthole 6 for the first medium can be reached from either side of the first region A1, why only one outlet porthole 6 for the first medium is sufficient. To the contrary, in the FIG. 2 configuration, there are two different outlet portholes 6' and 6" for the first medium.

Figure 4:
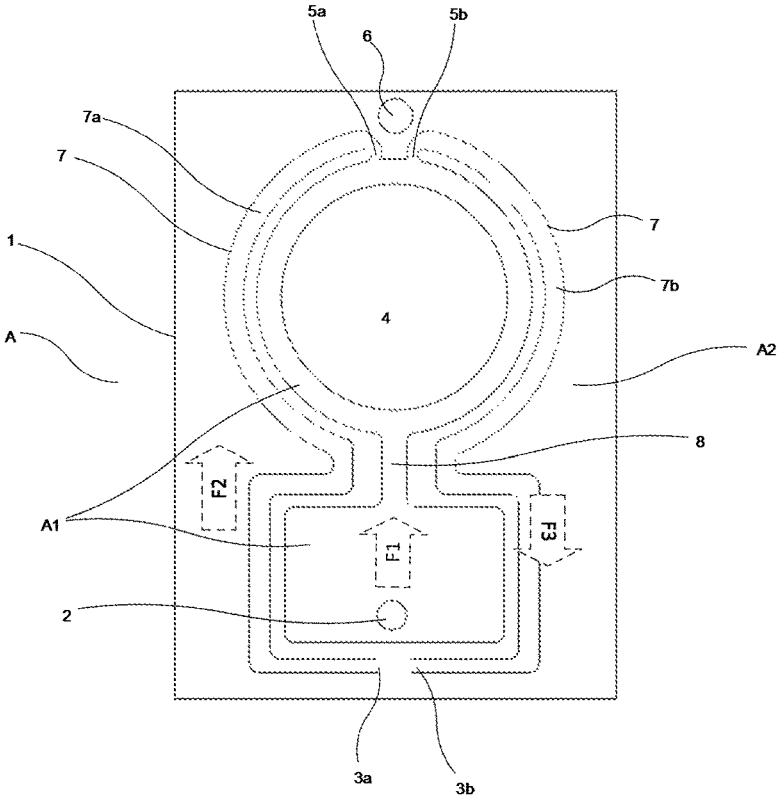
FIG. 4 is very schematic plan view of a first heat transferring surface of a fourth general embodiment of a plate according to the invention for a heat exchange arrangement said first heat transferring surface being arranged in use for contact with a first medium.

In the configuration illustrated in FIG. 4, there are two transfer channels 7*a*, 7*b*, one conveying first medium on either side of the first region A1. It is realized that there may be more than two such transfer channels 7*a*, 7*b*. Everything which is said herein regarding the transfer channel 7*a* is equally applicable to transfer channel 7*b*.

Figure 3:
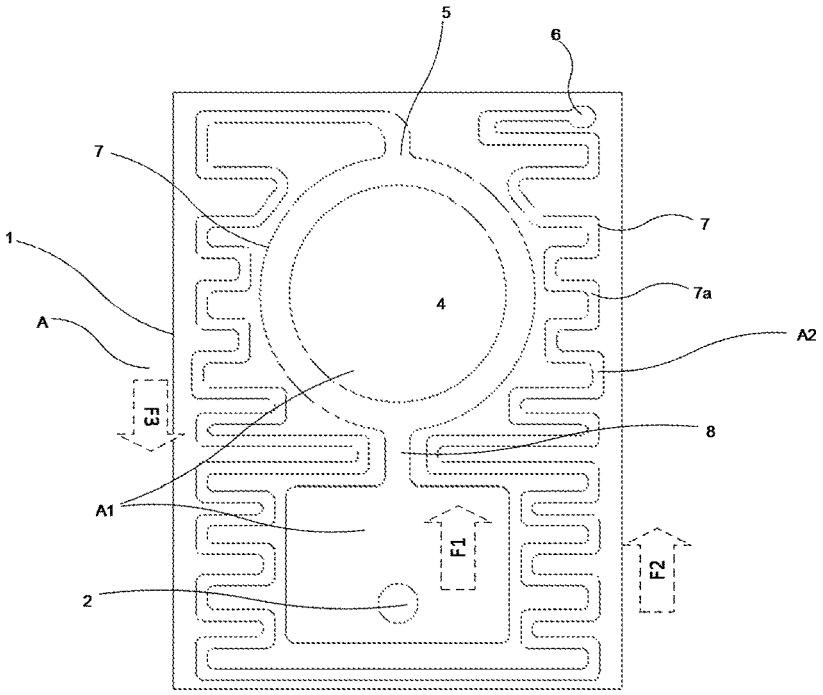
FIG. 3 is a very schematic plan view of a first heat transferring surface of a third general embodiment of a plate according to the invention for a heat exchange arrangement, said first heat transferring surface being arranged in use for contact with a first medium.

FIG. 3 illustrates a configuration wherein the transfer channel 7*a* has been extended so that it covers the second region A2. Hence, when the first medium traverses the second region A2, it does so in the transfer channel 7*a*. In FIG. 3, the transfer channel 7*a* is in fact connected to the outlet porthole 6 for the first medium, so that the first medium never leaves the transfer channel 7*a* on its way through the second region A2. This way, the second region A2 is formed as a downstream part of the elongated transfer channel 7*a*. It is, however, realized that FIGS. 1 and 3 represent two opposite extremes, and that intermediate solutions are also feasible, in which the transfer channel 7*a* extends a certain way along the extension of the second region A2 but where it comprises a transfer channel 7*a* exit 3 through which the first medium leaves the transfer channel 7*a* before passing the outlet porthole 6 for the first medium.

In the example shown in FIG. 4, a configuration similar to that shown in FIG. 1 is shown, but with the ridge 7 forming two channels 7*a*, 7*b*, each running on either side of the first region A1 from a respective channel inlet 5*a*, 5*b* near the outlet porthole 6 to a respective channel outlet 3*a*, 3*b* near the inlet porthole 2. It is realized that each sub channel 7*a*, 7*b* may run as illustrated in FIG. 1 or FIG. 2, independently on how the other sub channel runs. Hence, asymmetric configurations are foreseeable, as well as symmetric ones. Also, there may be more than two channels, depending on the detailed requirements.

Figure 5:
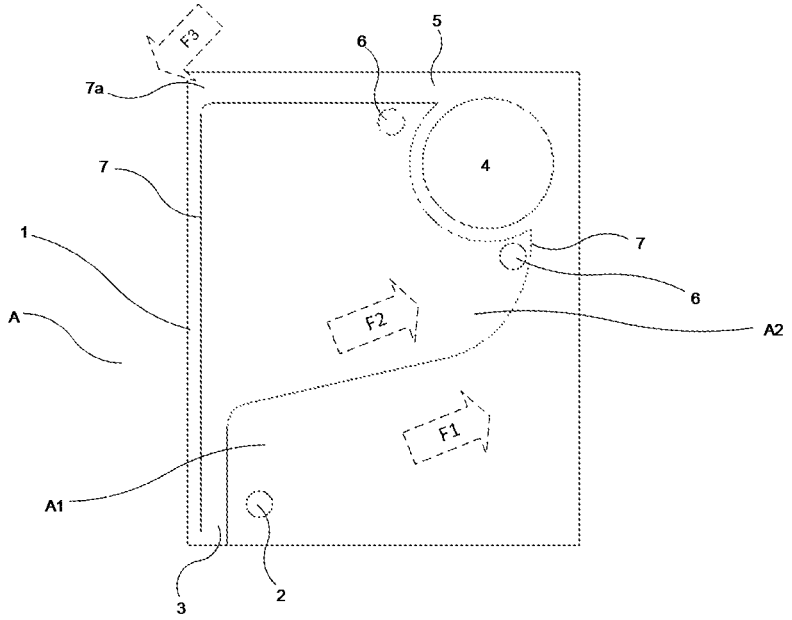
FIG. 5 is a very schematic plan view of a first heat transferring surface of a fifth general embodiment of a plate according to the invention for a heat exchange arrangement, said first heat transferring surface being arranged in use for contact with a first medium.
Figure 6:
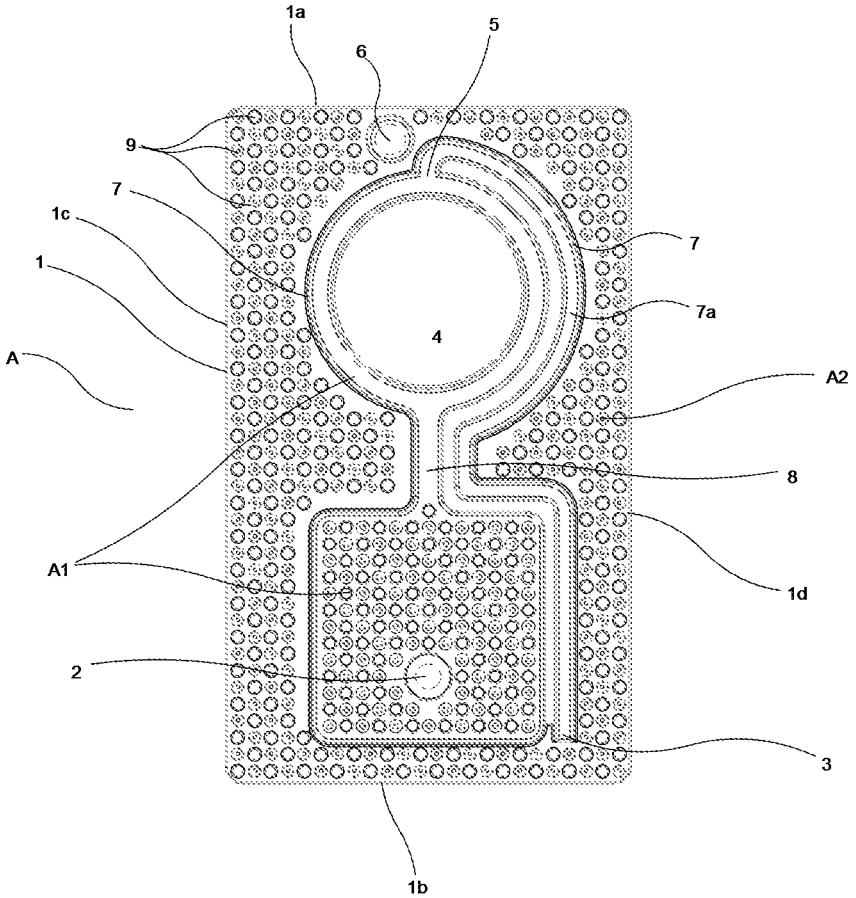
FIG. 6 is a plan view of a first heat transferring surface of an advantageous sixth embodiment of a plate according to the invention for a heat exchange arrangement, said first heat transferring surface being arranged in use for contact with a first medium.
Figure 7:
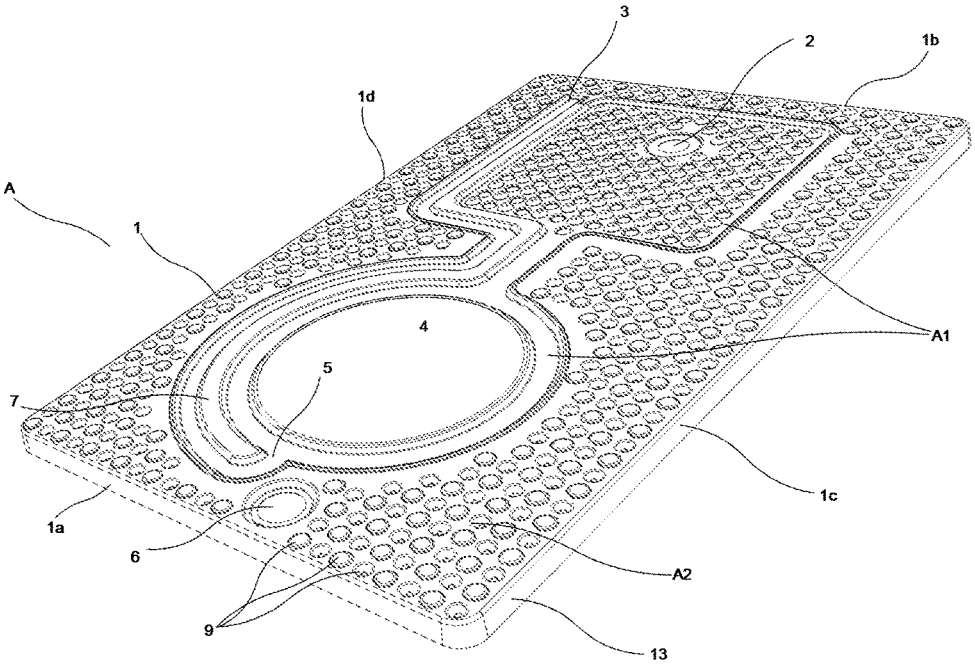
FIG. 7 is a perspective view of the first heat transferring surface of the plate according to FIG. 6.
Figure 8:
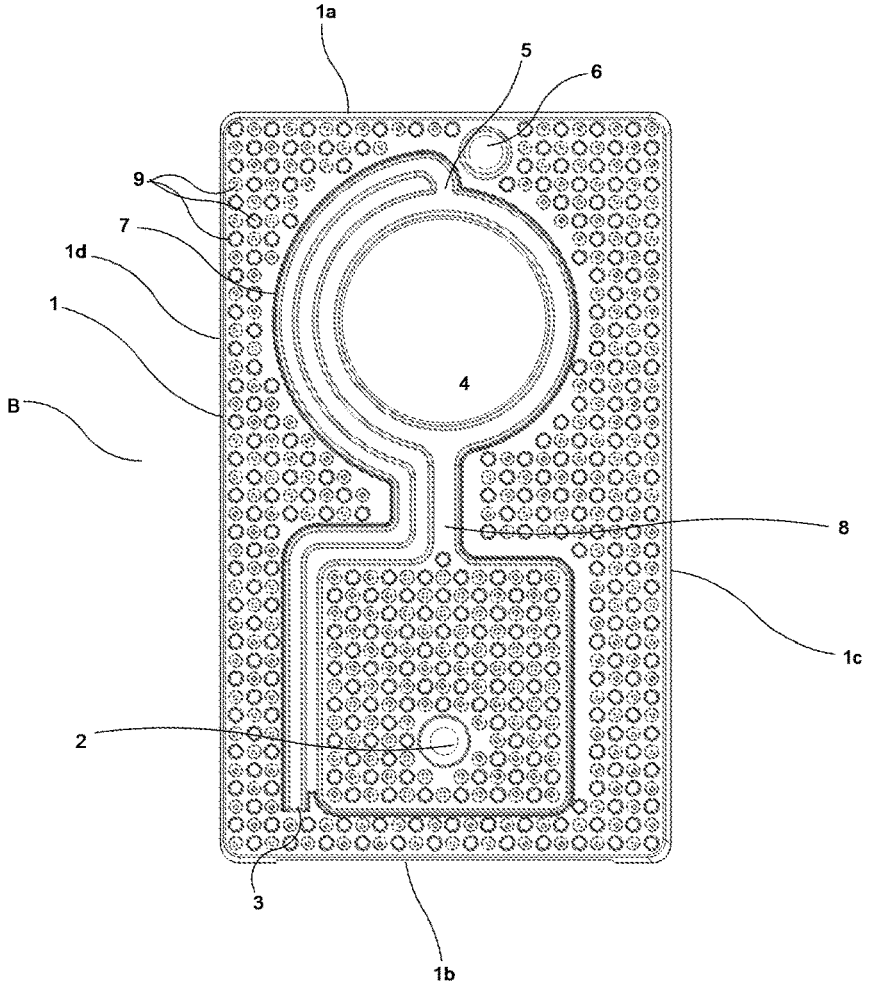
FIG. 8 is a plan view of a second heat transferring surface of the plate of FIG. 6, said second heat transferring surface being arranged in use for contact with a second medium.
Figure 9:
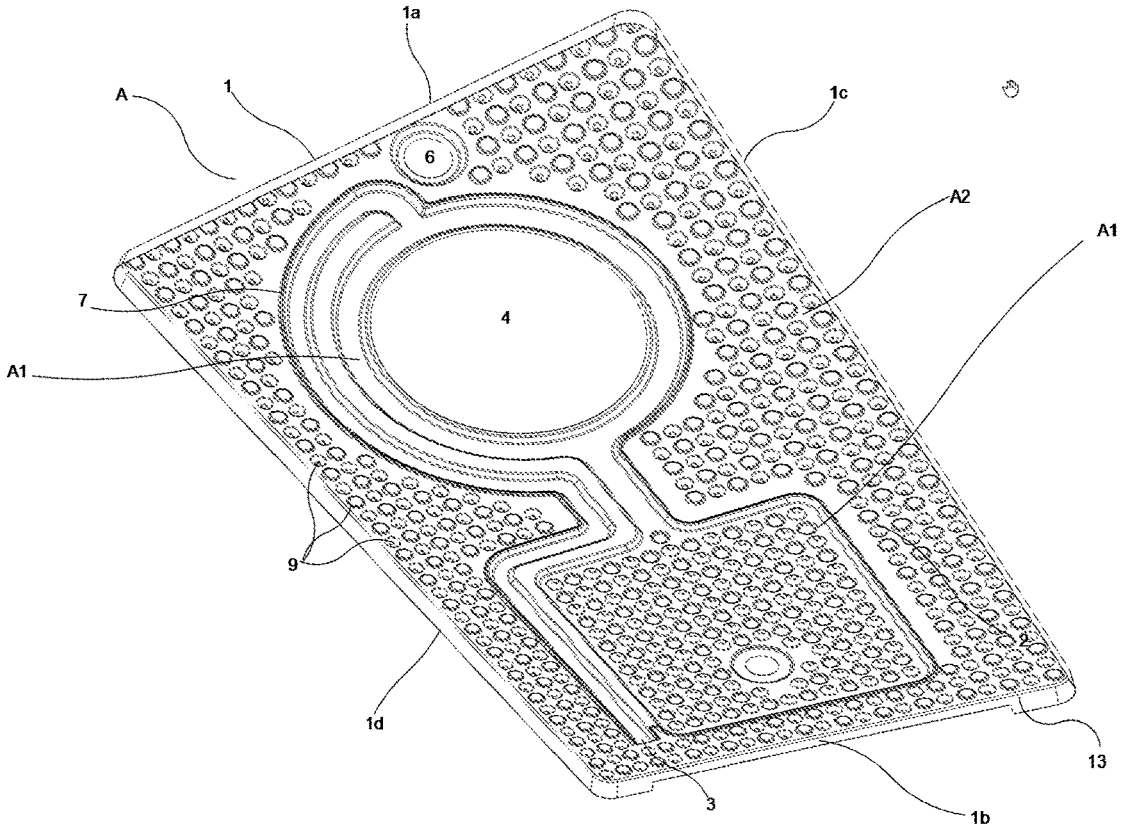
FIG. 9 is a perspective view of the second heat transferring surface of the plate according to FIG. 8.

FIG. 5 illustrates a different configuration, wherein the combination of the transfer channel 7*a* and the first region A1 surrounds the second region A2.

In the embodiments of the plate according to the present invention illustrated in FIGS. 2-4, and also in FIG. 5, and as furthermore is the case in FIG. 1, the plate 1 is configured as defined above and is accordingly provided with a respective inlet porthole 2 for the first medium, with a respective inlet porthole 4 for the second medium, with a respective outlet porthole 6 for the first medium and with a respective protrusion 7 forming a continuous ridge which is arranged to divide the respective first heat transferring surface A into a respective first region A1 and a respective second region A2.

In the illustrated embodiments according to FIGS. 1-4, and also in FIG. 5, the respective inlet porthole 4 for the second medium is located between the first inlet porthole 2 and the transfer channel 7*a* inlet 5, for optimum cooling of the second medium.

Although the protrusion 7 as mentioned can be configured in any way to separate the first region A1 and the second region A2 from each other, the protrusion 7 is, as is illustrated in FIGS. 1-4, advantageously configured to define a restriction 8 between said inlet porthole 2 for the first medium and said inlet porthole 4 for the second medium, in order to be able to guide the flow of the first medium towards and around the inlet porthole 4 for the second medium in an optimum manner.

It is understood that the restriction 8 is preferred but optional. The ridge 7 and the first region A1 may hence also be designed without the restriction 8.

Figure 13:
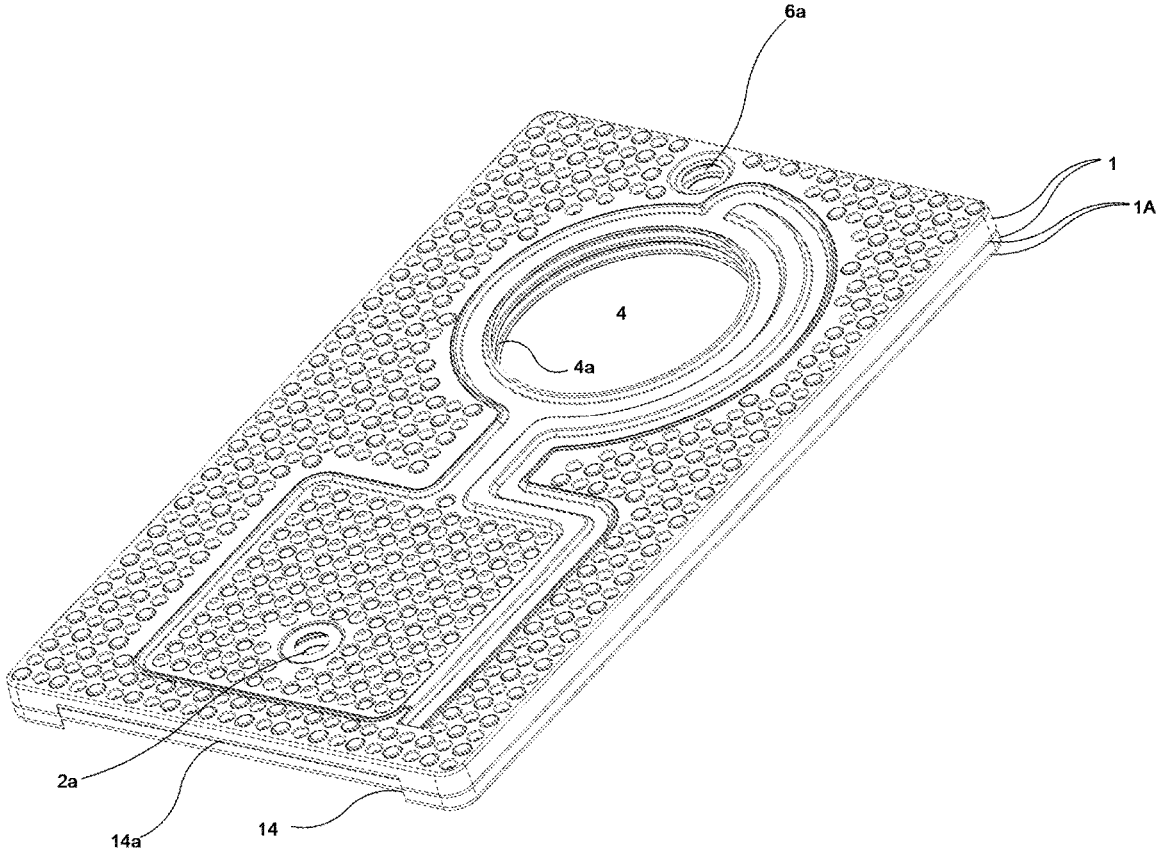
FIG. 13 is a perspective view of an assembly of four plates of said sixth type in an alternately stacked arrangement.
Figure 14:
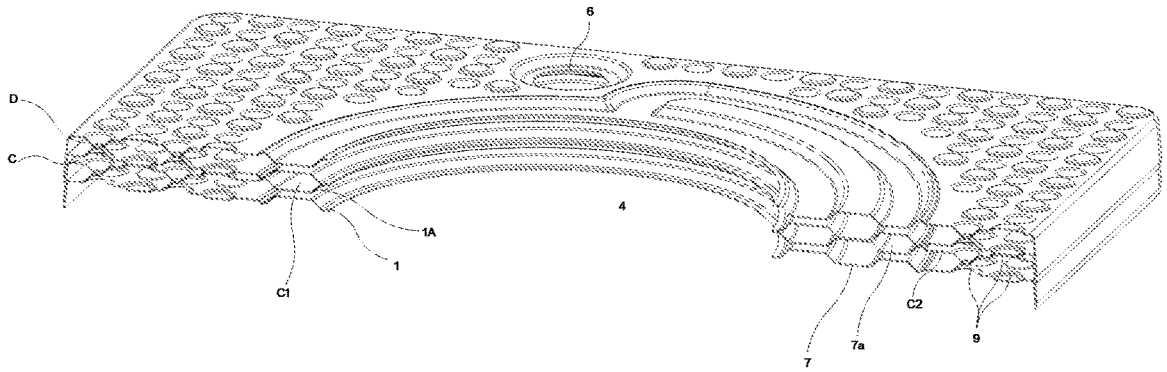
FIG. 14 is a perspective section view of a portion of the plates according to FIG. 13.
Figure 15:
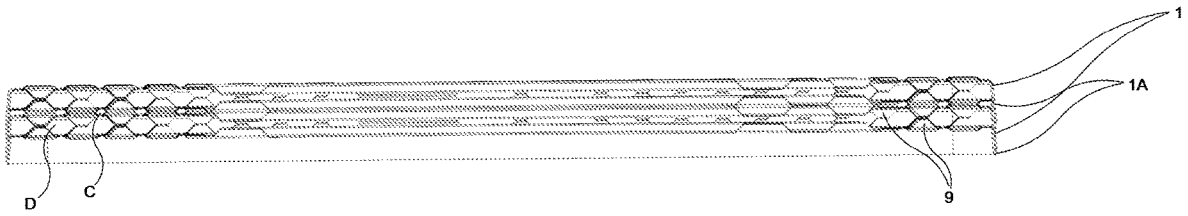
FIG. 15 is a side view of the plate portions according to FIG. 14.

FIGS. 6-15 illustrate the plate according to the present invention in more detail. The plate illustrated in FIGS. 6-12 corresponds to that shown in FIG. 1. The plate stack assembly illustrated in FIGS. 13-15 is made from plates that also correspond to the one shown in FIG. 1, but every other plate in the plate stack is mirrored, while the bent edges of the plates are all turned in the same direction, Thus, the plate 1 of particularly FIGS. 6-12 and the plate 1A of particularly FIG. 13-15 are each configured as defined above and is accordingly provided with an inlet porthole 2 for the first medium, with an outlet porthole 6 for the first medium, with an inlet porthole 4 for the second medium, with a transfer channel 7*a* entry 5 for the first medium, whereby the inlet porthole 4 for the second medium is located between the inlet porthole 2 and the transfer channel 7*a* outlet 5, and with a protrusion 7 forming a continuous ridge on a first heat transferring surface A for the first medium of the plate in question. As illustrated in FIG. 6-15, the protrusion 7 forms a corresponding continuous depression on a second heat transferring surface B for the second medium on the opposite side of the plate. The protrusion 7 is, as in the embodiments of FIGS. 1-5, arranged to divide the first heat transferring surface A into a first region A1 and a second region A2, and forms a restriction 8 between said inlet porthole 2 for the first medium and said inlet porthole 4 for the second medium, similarly to the embodiments of FIGS. 1-5, in order to be able to guide the flow of the first medium towards and around the inlet porthole 4 for the second medium in an optimum manner.

As also illustrated in FIG. 6-15, the plate 1, 1A is further configured with a plurality of dimples 9 forming elevations and corresponding depressions on the first and second heat transferring surfaces A, B. The number, size and arrangement of the dimples 9 can vary.

The plate can be rectangular as illustrated in FIGS. 1-5, square, shaped as a rhombus or as a rhomboid, having four sides or edges 1*a*, 1*b*, 1*c* and 1*d*, i.e. two opposing parallel shorter sides or edges 1*a* and 1*b* and two opposing parallel longer sides or edges 1*c* and 1*d*, and having right or non-right corners. The inlet porthole 4 for the second medium, the transfer channel 7*a* inlet 5 and the outlet porthole 6 for the first medium are located in close proximity to one edge 1*a* of the plate 1 and the inlet porthole 2 for the first medium as well as the transfer channel 7*a* outlet 3 are located in close proximity to the opposite edge 1*b* of the plate, i.e. in the illustrated embodiment close to the opposing shorter sides or edges of the plate, or, in other words, the distance between said outlet and inlet portholes respectively, and said one side and said opposite side respectively, is insignificant in relation to the distance between said outlet and inlet portholes. It is within the scope of the invention possible to give the plate 1 any other quadrilateral configuration.

As illustrated in FIG. 6-15, the transfer channel 7*a* inlet 5 and the inlet porthole 2 for the first medium are located in close proximity to a center line running from a center portion of said one edge 1*a* to a center portion of said opposite edge 1*b* respectively, of the plate 1, 1A. Also, the outlet porthole 6 for the first medium and the transfer channel 7*a* inlet 3 are located substantially diagonally opposite each other in close proximity to said one edge 1*a* and said opposite edge 1*b* respectively, of the plate 1, 1A. In an advantageous embodiment, the outlet porthole 6 is located in close proximity to the corner defined between edges 1*a* and 1*c* of the plate 1, 1A and the second inlet porthole 3 in close proximity to the corner defined between edges 1*b* and 1*d* of the plate, as illustrated in the drawings.

Even if this is not shown in the figures, the inner region A1 and the outer region A2 on the first heat transferring surface A of the plate 1, 1A may be configured with broken longitudinal protrusions, extending perpendicularly to the general fluid flow at the location in question while letting through fluid due to interruptions in said longitudinal protrusions. This way, the flow of the first medium through said regions is controlled, and in use, the flow of the first medium is guided from the respective inlet to the respective outlet in said first A1 and second A2 regions such that optimum cooling of the second medium is achieved and thereby, optimum heating of said first medium is achieved. Depressions corresponding to the said broken longitudinal protrusions are then found on the second heat transferring surface B of the plate 1, 1A. Such broken longitudinal protrusions can be configured in any other suitable way in order to provide for the best possible control and guidance of the flow of the first medium.

Figure 10:
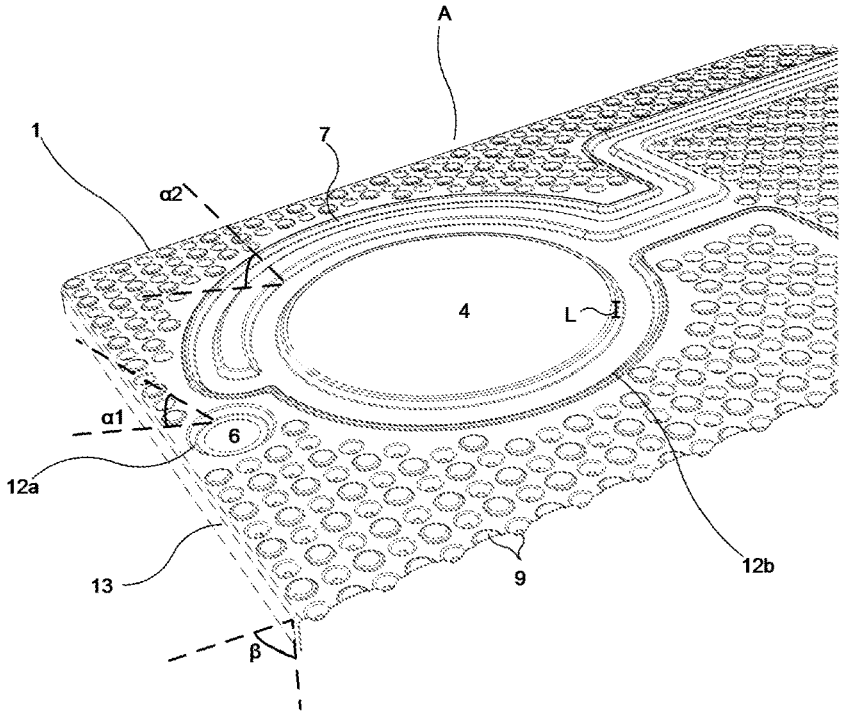
FIG. 10 is a perspective section view of a portion of said first heat transferring surface of the plate according to FIGS. 8 and 9.
Figure 11:
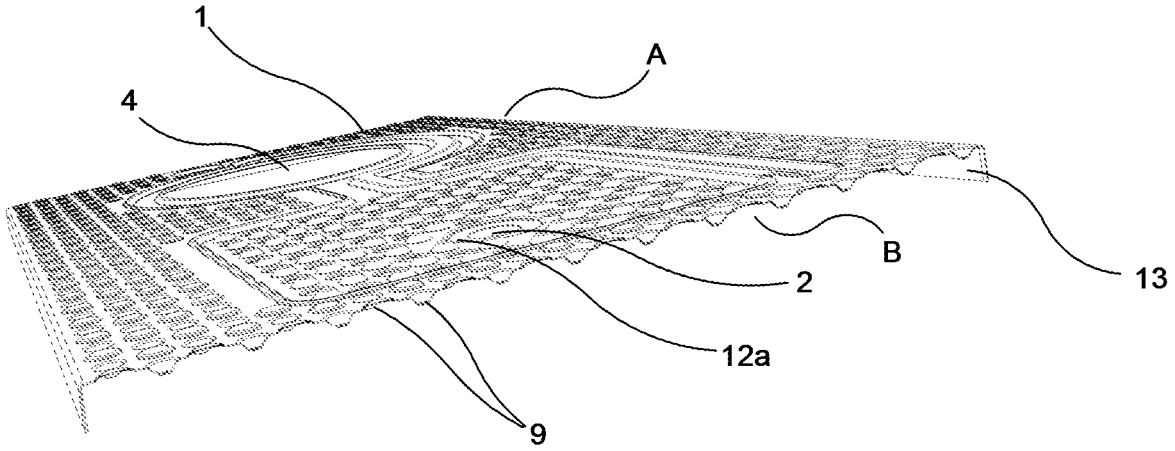
FIG. 11 is a perspective section view of another portion of said first heat transferring surface of the plate according to FIGS. 8 and 9.
Figure 12:
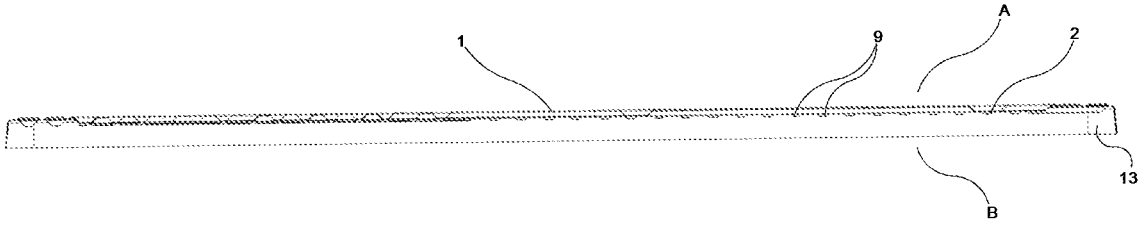
FIG. 12 is a side section view of the plate portion according to FIG. 11.

The periphery of each of the inlet porthole 2 and the outlet porthole 6 for the first medium is folded at an angle $\alpha$1 (see FIG. 10). This angle $\alpha$1 may be more than e.g. 75 degrees with respect to the second heat transferring surface B of the plate 1, 1A. However, the angle $\alpha$1 may alternatively be less than 75 degrees and the folds 12*a* can also be configured in other ways if desired. Furthermore, it is within the scope of the invention that the configurations as well as the angles of the portholes 2, 6 in a plate 1, 1A may vary. To minimize thermal stresses, the periphery of particularly the inlet porthole 4 for the second medium however, is advantageously folded at an angle $\alpha$2 (see FIG. 10) of e.g. more than 75 degrees with respect to the first heat transferring surface A of the plate 1, 1A, even if the angle $\alpha$2 also may be less than 75 degrees and the fold 12*b* also can be configured in other ways if desired. In any case it is important to see to that in use, a secure sealing is obtained towards the heat transferring surface A or B in question such that the first and the second media are prevented from penetrating into that heat transferring surface A or B which is intended for the other medium. The length L of the fold 12*b* of the inlet porthole 4 for the second medium is less than twice the height of the elevations formed by the dimples 9. The folds 12*a* of the inlet porthole 2 and the outlet porthole 6 for the first medium may have the same length.

The plate 1, 1A according to the present invention is configured to permit assembly with additional plates for the heat exchange arrangement, such that the first heat transferring side A of the plate together with a first heat transferring side A of an adjacent plate defines a first flow channel or through-flow duct for the first medium and such that the second heat transferring side B of the plate together with a second heat transferring side B of another adjacent plate defines a second flow channel or through-flow duct for the second medium.

Since the embodiment of the plate 1, 1A described above and illustrated in FIG. 6-15 is not symmetric (which is true also for the plate 1 of FIGS. 1-5), the heat exchange arrangement may as illustrated comprise a plurality of first plates 1 according to FIGS. 6-12 and a plurality of second plates 1A. The second plates 1A are mirror copies of the first plates 1 and said first and said second plates are alternately stacked to form a repetitive sequence of a first flow channel C for the first medium and a second flow channel D for the second medium. Each first flow channel C is defined by the first heat transferring surface A of the first plate 1 and the first heat transferring surface A of the second plate 1A, and each second flow channel D is defined by the second heat transferring surface B of the first plate 1 and the second heat transferring surface B of the second plate 1A. Four plates which are stacked on top of each other are illustrated in FIGS. 13-15. A preferred number of plates 1, 1A is for the intended purpose e.g. 20, but the number of plates may be less or more than 20.

It should be noted however, that it is within the scope of the present invention that the plate 1 alternatively can be configured to be symmetric. Thereby, the plate 1 and the plate 1A will be identical.

After assembly, the heat exchange arrangement can be located in connection to a burning chamber with at least one burner in a heating device.

The inlet porthole 2 for the first medium on the first and the second plates 1, 1A in the stack of plates define between them inlets 2*a* for the first medium. The outlet porthole 6 for the first medium on the first and the second plates 1, 1A in the stack of plates define between them outlets 6*a*, for the first medium. The inlet portholes 4 for the second medium on the first and the second plates 1, 1A in the stack of plates define between them inlets 4*a* for the second medium.

For optimum heating of the first medium and yet, optimum cooling of the second medium such that the plates 1, 1A are not subjected to excessive thermal stresses which might affect the plates negatively and facilitate the origin of leakage when used in a heat exchange arrangement, a particularly important feature of the heat exchange arrangement of the present invention is that the protrusions 7 on the first heat transferring surfaces A of the first and the second plates 1, 1A are connected to each other to separate each first flow channel C into a first and a second flow path C1 and C2 for the first medium such that each first flow path C1 is configured in use to direct a flow of the first medium from the inlet 2*a* for the first medium to the transfer channel 7*a* inlet 5, defined by the same heat transferring surfaces A, inside the first region A1, and each second flow path C2 is configured in use to direct the flow of the first medium from the transfer channel 7*a* outlet 3, also defined by the same heat transferring surfaces A, to the outlet 6 in the second region A2. Thanks to the restriction 8 of the protrusions 7, the flow of the first medium through the flow paths C1 is therefore directed more directly towards and around the inlets 4*a* for the second medium for more effective cooling of said second medium.

Thanks to the flow of the first medium first through the first flow path C1 and then through the second flow path C2 of each first flow channel C, it is now possible to subject the second medium to repeated cooling, i.e. cooling in two steps, first where the second medium has its highest temperature of about 1500° C., namely at the inlets 4*a* for said second medium, for cooling to about 900° C. in the first regions A1 which also surround said inlets and then secondly in the second regions A2 in which the second medium is cooled from about 900° C. to about 150° C. At the same time, the first medium is heated by the second medium from about 20° C. to about 40° C. during the flow of said first medium through the first flow paths C1 and then from about 40° C. to about 60° C. during the flow of said first medium through the second flow paths C2.

Through the restriction 8 defined by said protrusions 7, the flow of the first medium inside the first regions A1 is guided towards the inlets 4*a* for the second medium for most effective cooling of said second medium where the temperature thereof is at its highest.

In order to enable the feedback of the first medium for the second cooling step of the second medium, the transfer channel 7*a* inlets 5 stand in flow communication with the transfer channel 7*a* outlets 3 by means of the transfer channel 7*a*. The transfer channel 7*a* may be provided with dimples 19 of any suitable type or shape to create turbulence in the transfer channel 7*a*.

Thus, if the heat exchange arrangement comprises a stack of e.g. 20 plates 1, 1A, the first medium flowing from the inlets 2*a* therefor through e.g. 10 different first flow paths C1 defined by the first regions A1 of the first heat exchange surfaces A of respective two plates 1 and 1A in the stack of plates to the transfer channel 7*a* inlets 5, will, when the heat exchange arrangement is in use, gather at the respective inlets 5 to the respective transfer channel 7*a* and flow through the transfer channel 7*a* to the respective transfer channel 7*a* outlets 3, and from there continue through said respective second flow paths C2 defined by the outer regions A2 of the first heat exchange surfaces A of respective two plates 1 and 1A in the stack of plates and flow through said second flow paths C2 to the outlets 6 and finally from there leave the heat exchange arrangement.

The edges 1*a*-1*d* of the first and the second plates 1, 1A are folded away from the respective surface at an angle β greater than 75 degrees in the same direction (see FIG. 10). Accordingly, in the illustrated embodiments, the folds 13 of the first plates 1 are configured to surround the first heat transferring surfaces A thereof and the folds 13 of the second plates 1A are configured to surround the second heat transferring surfaces B thereof. When the plates 1, 1A are stacked on top of each other, the folds 13 overlap each other. Thus, the folds 13 are configured such that the first flow channel C is completely sealed at all edges and such that the second flow channel D is completely sealed at all but one edge, said one edge being only partially folded for defining an outlet 14*a* for the second medium to leave the heat exchange arrangement. In the illustrated embodiments, and in particular in FIGS. 13-15, the outlet 14*a* for the second medium is defined at the edge 1*b* opposite to the edge 1*a* which is in close proximity to which the transfer channel 7*a* inlets 5 and the outlets 6*a* for the first medium and the inlet 4*a* for the second medium are defined, i.e. at the edge close to which the inlets 2 for the first medium and the transfer channel 7*a* outlets 3 are defined. An outlet 14*a* is defined between recesses 14 which are formed by the partially folded edges 1*b*, i.e. in the folds 13 of two stacked plates 1, 1A of which the second heat transferring surfaces B face each other.

In use, the heat exchange arrangement is advantageously arranged such that the edges 1*b* of the plates 1, 1A forming the heat exchange arrangement and defining between them each outlet 14*a* for the second medium, are facing downwards. This while condensation of the second medium occurs primarily in the area of the plates just upstream of these outlets 14*a* and condensate will much easier flow out through the outlets 14*a* if they are facing downwards.

Figure 16:
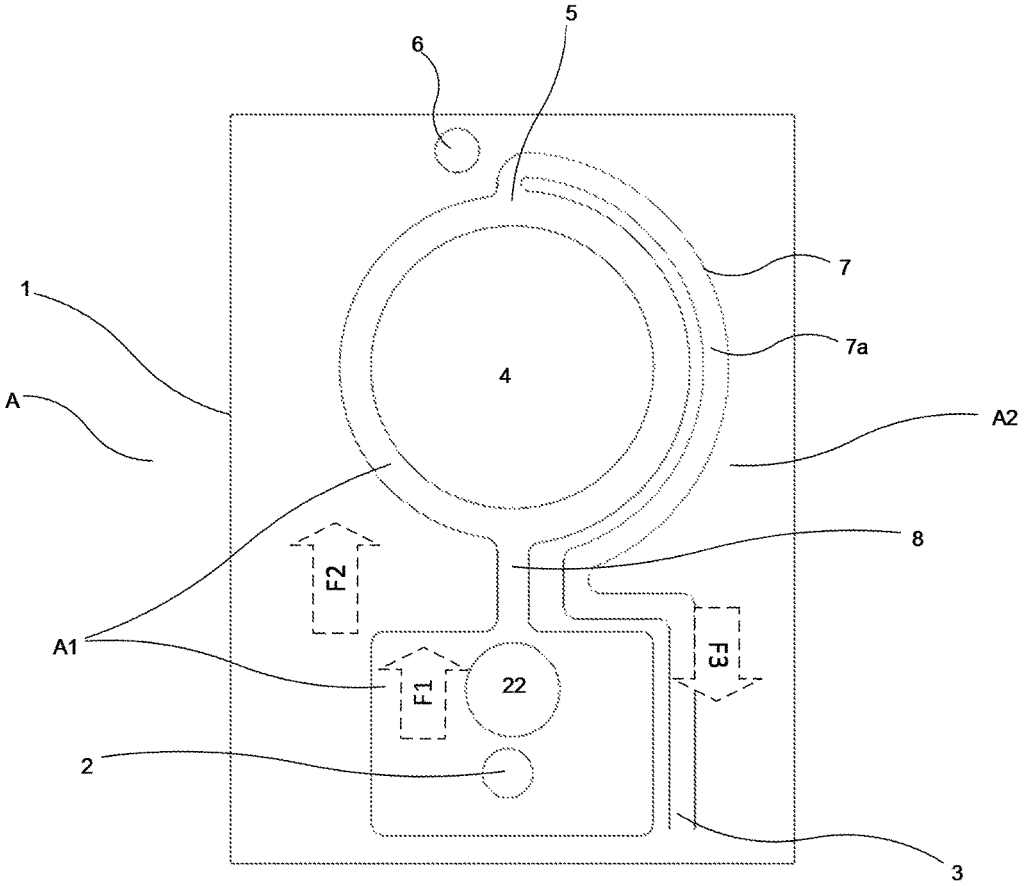
FIG. 16 is a very schematic plan view of a first heat transferring surface of an eighth general embodiment of a plate according to the invention for a heat exchange arrangement, said first heat transferring surface being arranged in use for contact with a first medium.

As schematically illustrated in the alternative embodiment of FIG. 16, the plate 1 may be configured also with an outlet porthole 22 for the second medium. The periphery of this outlet porthole 22 may optionally, as the inlet porthole 4 for the second medium, be folded at an angle of more than 75 degrees with respect to the first heat transferring surface A of the plate 1, but may also be configured in other ways. Such outlet porthole 22 is used instead of the outlets 14*a* described above.

After assembly to a heat exchange arrangement, the outlet portholes 22 for the second medium define between them outlets for the second medium. At this alternative embodiment, each second flow channel defined between second heat transferring surfaces of first and second plates as defined above is, similar to the first flow channel, completely sealed at all edges.

It is obvious to a skilled person that the plate according to the present invention for the heat exchange arrangement can be modified and altered within the scope of subsequent claims directed to heat exchange plate without departing from the idea and object of the invention. Thus, it is possible to e.g. give the protrusion which divides the first heat transferring surface of each plate into a first region as well as a second region or the protrusions which divide the first heat transferring surface of each plate into a first region, a second region and one or more additional regions any suitable shape in order to provide for an optimum flow of the first medium through said regions. It is also possible to configure the one or more protrusions and locate the inlet and outlet portholes for the first and second media such that the plates are symmetric and only one type of plate will be needed. The size and shape of the portholes can vary. The size and shape of the plates can vary. The plates can instead of being shaped as a parallelogram (e.g. square, rectangular, rhomboid, rhombus) be e.g. trapezoid, with two opposing parallel sides or edges and two opposing non-parallel sides or edges.

It is obvious for a skilled person that the heat exchange arrangement according to the present invention can also be modified and altered within the scope of subsequent claims directed to a heat exchange arrangement without departing from the idea and object of the invention. Accordingly, the number of plates in the heat exchange arrangement can e.g. vary. Even if the preferred number of plates can be e.g. 20, it is of course also possible to stack more than 20 and less than 20 plates in a heat exchange arrangement according to the present invention. Also, the plates and the various portions and parts thereof can vary in size, as mentioned, such that e.g. the height of the first and second flow channels for the first and second media respectively, can vary and accordingly, the height of the elevations formed by the dimples as well.

Furthermore, in the embodiments illustrated herein, there is typically one first or inner region and one second or outer region. It is possible, in additional embodiments falling within the scope of the present invention, to have more than two such regions, such as for instance at least three such regions. In this case, a respective ridge channel, like the one described above in connection to the figures, is arranged to convey the first medium from a first to a second regions, then an additional ridge channel, of the same type, is arranged to convey the first medium from the second region to a third region, and so on.

Furthermore in this case, each first flow channel C described above is then configured in use to direct a flow of the first medium from the inlet 2*a*) for the first medium to the outlet 6, 6', 6" for the first medium, via the first region A1, the transfer channel 7*a*, 7*b* and the second region A2, and in addition via a third and possibly subsequent region, possibly via respective additional transfer channels.

Preferably, the regions are then concentric, in the sense that a third region is arranged to surround a second region, which is arranged to surround a first region, and so on.

The invention claimed is:

1. A plate for a heat exchange arrangement for the exchange of heat between a first and a second medium, comprising:

a first heat transferring surface arranged in use to be in contact with the first medium and a second heat transferring surface arranged in use to be in contact with the second medium;

an inlet porthole for the first medium at a first end of the first heat transferring surface;

an inlet porthole for the second medium; and an outlet porthole for the first medium at a second end of the first heat transferring surface, the first end spaced from the second end in a first direction, wherein the first heat transferring surface comprises at least one ridge arranged to divide said first heat transferring surface into at least a first region in direct thermal contact with the inlet porthole for the second medium, and a second region not in direct thermal contact with the inlet porthole for the second medium, and wherein the inlet porthole for the first medium is arranged in said first region, wherein the outlet porthole for the first medium is arranged in the second region, wherein the first region has an outlet, wherein a transfer channel conveys the first medium from the first region to the second region, the transfer channel having an inlet connected to and extending from the outlet of the first region in the first direction toward the inlet porthole for the first medium.

2. The plate for a heat exchange arrangement according to claim 1, wherein the inlet porthole for the second medium is surrounded by the first region.

3. The plate for a heat exchange arrangement according to claim 1, wherein the first region and the second region are separated by and share one and the same part of said at least one ridge, and wherein a general flow direction of the first medium through the first and second regions on either side of said part of the at least one ridge, respectively, are substantially parallel.

4. The plate for a heat exchange arrangement according to claim 3, wherein the transfer channel is arranged to convey the first medium, between the first region and the second region, in a direction generally opposite to the parallel general flow direction.

5. The plate for a heat exchange arrangement according to claim 1, wherein a length of the transfer channel in a flow direction through the transfer channel is greater than a width of the transfer channel, the width of the transfer channel being perpendicular to the flow direction through the transfer channel.

6. The plate for a heat exchange arrangement according to claim 1, wherein the inlet of the transfer channel, at the first region, is arranged closer to the inlet porthole for the second medium than an outlet of the transfer channel, at the second region.

7. The plate for a heat exchange arrangement according to claim 1, wherein the inlet porthole for the second medium is located between the inlet porthole for the first medium and the inlet of said transfer channel, at the first region, and wherein the at least one ridge is configured to define a restriction between the inlet porthole for the first medium and the inlet porthole for the second medium.

8. The plate for a heat exchange arrangement according to claim 1, wherein the plate is shaped substantially as a parallelogram, and wherein the inlet porthole for the second medium and the inlet of the transfer channel are located in close proximity to one edge of the plate, and the inlet porthole for the first medium is located in close proximity to the opposite edge of the plate.

9. The plate for a heat exchange arrangement according to claim 8, wherein the transfer channel inlet and the inlet porthole for the first medium are located in close proximity to a line running from a center point of said one edge to a center point of said opposite edge respectively, of the plate.

10. The plate for a heat exchange arrangement according to claim 8, wherein the outlet porthole for the first medium and an outlet of the transfer channel are located substantially diagonally opposite each other in close proximity to said one edge and said opposite edge, respectively, of the plate.

11. The plate for a heat exchange arrangement according to claim 1, wherein the first region and the second region on the first heat transferring surface of the plate are configured with broken longitudinal protrusions for controlling the flow of the first medium.

12. The plate for a heat exchange arrangement according to claim 1, wherein a periphery of the inlet porthole for the second medium is folded at an angle of more than 75 degrees with respect to the first heat transferring surface of the plate.

13. The plate for a heat exchange arrangement according to claim 12, wherein a height of the fold is less than twice a height of elevations formed by dimples.

14. The plate for a heat exchange arrangement according to claim 1, wherein the second region is formed as a downstream part of the transfer channel.

15. The plate for a heat exchange arrangement according to claim 1, wherein the transfer channel has a first section extending away from the outlet porthole for the first medium.

16. The plate for a heat exchange arrangement according to claim 1, wherein the outlet of the first region is between the outlet for the first medium and an outlet of the transfer channel in the first direction.

* * * * *